US006974341B2

(12) United States Patent
Jennings

(10) Patent No.: US 6,974,341 B2
(45) Date of Patent: Dec. 13, 2005

(54) SUBSEA WELL ELECTRICAL CONNECTOR

(75) Inventor: Charles E. Jennings, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 10/684,927

(22) Filed: Oct. 14, 2003

(65) Prior Publication Data

US 2005/0075013 A1 Apr. 7, 2005

Related U.S. Application Data

(60) Provisional application No. 60/418,582, filed on Oct. 15, 2002.

(51) Int. Cl.[7] ..... H01R 4/60
(52) U.S. Cl. ..... 439/191; 439/140; 439/310
(58) Field of Search ..... 439/191–194, 439/310, 140

(56) References Cited

U.S. PATENT DOCUMENTS

| | | | | |
|---|---|---|---|---|
| 3,431,428 | A * | 3/1969 | Van Valer | 307/10.1 |
| 3,638,732 | A | 2/1972 | Huntsinger et al. | |
| 3,848,949 | A | 11/1974 | Falkner | |
| 4,188,084 | A * | 2/1980 | Buresi et al. | 439/201 |
| 4,289,199 | A | 9/1981 | McGee | |
| 4,438,996 | A * | 3/1984 | Zehren | 439/137 |
| 4,491,176 | A | 1/1985 | Reed | |
| 4,589,492 | A | 5/1986 | Greiner et al. | |
| 5,049,091 | A * | 9/1991 | Tanaka | 439/500 |
| 5,558,532 | A | 9/1996 | Hopper | |
| 5,749,608 | A * | 5/1998 | Wilkins et al. | 285/123.12 |
| 6,200,152 | B1 | 3/2001 | Hopper | |
| 6,681,861 | B2 * | 1/2004 | Davidson et al. | 166/382 |
| 6,776,636 | B1 * | 8/2004 | Cameron et al. | 439/191 |

FOREIGN PATENT DOCUMENTS

| | | |
|---|---|---|
| EP | 0637675 A1 | 2/1995 |
| GB | 2192316 A | 1/1988 |
| GB | 2321139 A | 7/1998 |
| WO | WO00/26998 | 5/2000 |

* cited by examiner

*Primary Examiner*—Neil Abrams
(74) *Attorney, Agent, or Firm*—Bracewell & Giuliani LLP

(57) ABSTRACT

A wellhead assembly has an electrical connector that has a movable inner member carried in a tubing hanger for stroking outward into engagement with an stationary outer component located in a passage in the sidewall of the wellhead or tree. A running tool releasably engages the tubing hanger and has an actuator that moves axially for setting the tubing hanger in the bore. The inner member of the electrical connection is movable in response to axial movement of the actuator of the running tool from a retracted position to an extended position in electrical engagement with the inner end of the outer member.

9 Claims, 5 Drawing Sheets

SUBSEA WELL ELECTRICAL CONNECTOR

RELATED APPLICATION

This application claims priority to provisional application Ser. No. 60/418,582, filed Oct. 15, 2002.

FIELD OF THE INVENTION

This invention relates in general to subsea electrical connectors and in particular to a connector for connecting electrical power to a subsea Christmas tree.

BACKGROUND OF THE INVENTION

One type of subsea well has a Christmas tree located on the sea floor. The tree mounts on a wellhead at the upper end of the well and has valves for controlling the well fluid. The well fluid flows upward through a string of production tubing that is suspended by a tubing hanger. In one type of subsea tree, the tubing hanger lands in the tree.

Downhole temperature and pressure are useful parameters to monitor. This normally requires pressure and temperature sensors located at the lower end of the string of tubing. An electrical wire extends alongside the tubing to the tubing hanger. This wire connects to an exterior wire that supplies voltage and monitors the pressure and temperature. The connector between the interior and the exterior wires may be located at various interfaces of the tree. One type of connector has a laterally movable shuttle member mounted in the sidewall of the tree that is remotely actuated to move into engagement with an electrical contact in the tubing hanger at the upper end of the interior wire. Electrical wires leading downhole are also needed for other purposes, such as for powering an electrical submersible pump.

SUMMARY OF THE INVENTION

The wellhead assembly of this invention is for use with an outer wellhead member mounted to an upper end of a well. The outer wellhead member has a sidewall defining a bore. An inner wellhead member lands in the bore. An electrical connection outer member is mounted in a passage formed in the sidewall. The outer member of the electrical connection has an inner end and an outer end, the outer end being connected to an exterior electrical conductor on the exterior of the outer wellhead member.

An electrical connection inner member is mounted to the inner wellhead member and connected to an interior electrical conductor leading to equipment in the well. The inner member has an outer end that is movable from a retracted position to an extended position in electrical engagement with the inner end of the outer member.

Preferably a lateral actuator member is located at an inner end of the inner member. The lateral member is laterally movable relative to an axis of the inner wellhead member for moving the inner member from the retracted position. An axial actuator member extends axially upward from the lateral actuator member, so that axial movement of the axial actuator member causes the lateral actuator member to move laterally.

BRIEF DESCRIPTION OF THE DRAWINGS

The novel features believed to be characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings.

DETAILED DESCRIPTION OF THE INVENTION

Figure 1:
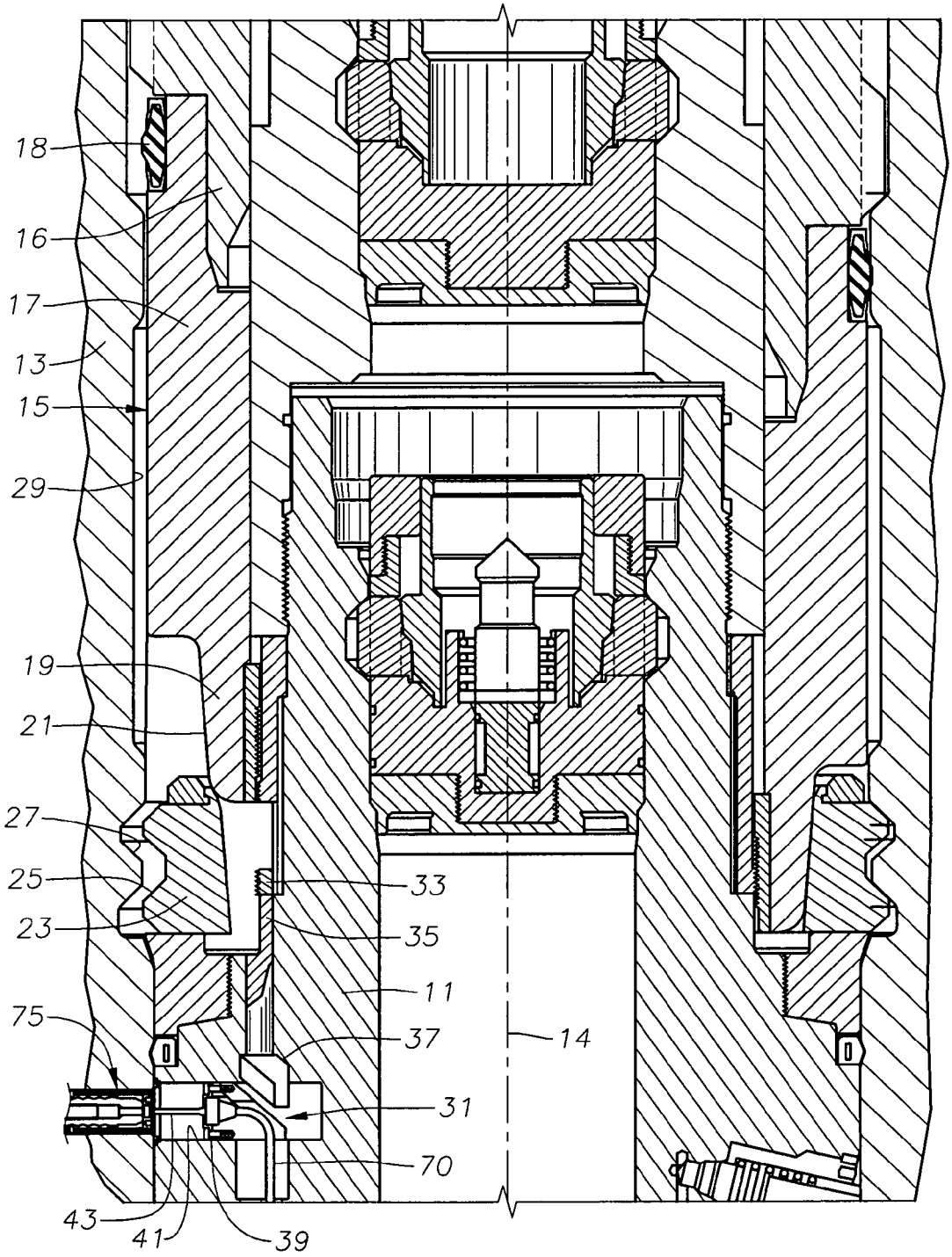
FIG. 1 is a cross-sectional side view of a tubing hanger landed within a horizontal tree, the tubing hanger and tree having wet-mate connectors according to the invention, the left side of the figure showing a tubing hanger locking sleeve and the connector in a disengaged position, the right side of the figure showing the locking sleeve in an engaged position.

FIG. 1 shows a tubing hanger 11 landed within a horizontal tree 13, each being concentric about a vertical central axis 14. A running tool 15 has a piston 16 that reciprocates vertically for setting a locking sleeve 17, sleeve 17 being used for locking hanger 11 in tree 13. A lower portion of piston 16 contacts an upper portion of sleeve 17 and exerts a downward force to move sleeve 17 from an upper, disengaged position, which is shown in the left half of FIG. 1, to a lower, engaged position, which is shown in the right half of the figure. A seal 18 is installed in an upper portion of sleeve 17 and a cylindrical skirt 19 depends from a lower portion of sleeve 17. Skirt 19 has a cam surface 21 for moving dogs 23 outward (away from central axis 14) when sleeve 17 is moved to the engaged position. Dogs 23 are moveably carried in hanger 11 and have a groove profile 25 on an outer surface for engaging a corresponding groove profile 27 in bore 29 of tree 13 when dogs 23 are moved outward. Hanger 11 lands on an upward-facing shoulder (not shown) in bore 29, which supports hanger 11 and prevents downward movement of hanger 11 within tree 13. Dogs 23 engage tree 13, as shown in the right side of the figure, to prevent upward movement of hanger 11 within tree 13.

An electrical connector 31 is installed in the sidewall of hanger 11 prior to hanger 11 being landed in tree 13. Connector 31 is shown in the disengaged position in the left side of FIG. 1. As running tool 15 forces sleeve 17 downward, a lower portion of sleeve 17 contacts an upper end 33 of a rod 35, rod 35 being reciprocatingly and vertically carried within hanger 11. The lower end of rod 33 is connected to a male block 37 that engages a female block 39, which is reciprocatingly and horizontally carried within cavity 41 in hanger 11. A conductor pin 43 extends from the outer surface of block 39 and is entirely recessed within cavity 41 when connector 31 is in the disengaged position.

This positioning of pin 43 permits hanger 11 to be lowered into tree 13 without damaging pin 43.

Figure 2:
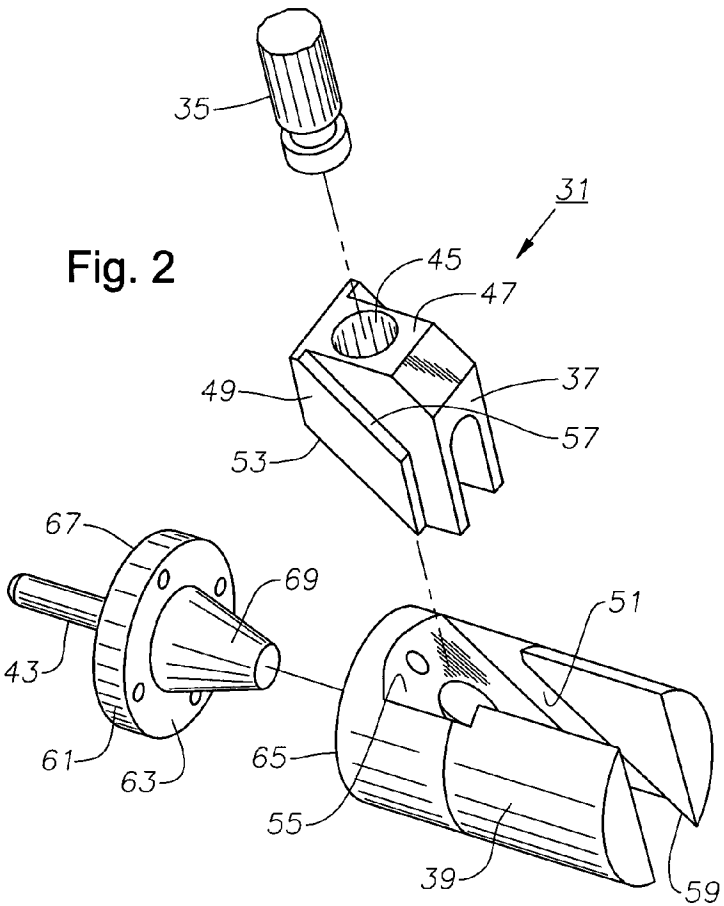
FIG. 2 is an exploded isometric view of the tubing hanger connector of FIG. 1.

FIG. 2 is an exploded isometric view of the components of connector 31. The lower end of rod 35 is sized for insertion into a hole 45 in upper surface 47 of male block 37. Inclined rails 49 are located on opposite lateral sides of block 37 for engaging corresponding grooves 51 in female block 39. As rod 35 moves block 37 downward, rails 49 enter and slide within grooves 51, and inclined surface 53 of block 37 slides against corresponding inclined surface 55 located between grooves 51. Downward force passes from sleeve 17 through rod 35, into block 37, and from surface 53 of block 37 to surface 55 of block 39, the downward vertical motion of rod 35 and block 37 causing outward horizontal motion of block 39. When sleeve 17 is lifted, such as during retrieval of hanger 11, upper edges 57 of rails 49 slide against upper surfaces 59 of grooves 51 for moving block 39 inward (toward central axis 14 of FIG. 1) as rod 35 moves block 37 upward.

A pin mount 61 comprises the outer end of block 39, inner surface 63 mounting to outer surface 65 of block 39. Pin 43 extends from outer surface 67 of pin mount 61, and connector 69 provides for connecting an electrical cable 70 (FIG. 1) to conduct electricity from pin 43 to downhole components supported by hanger 11.

Figure 3:
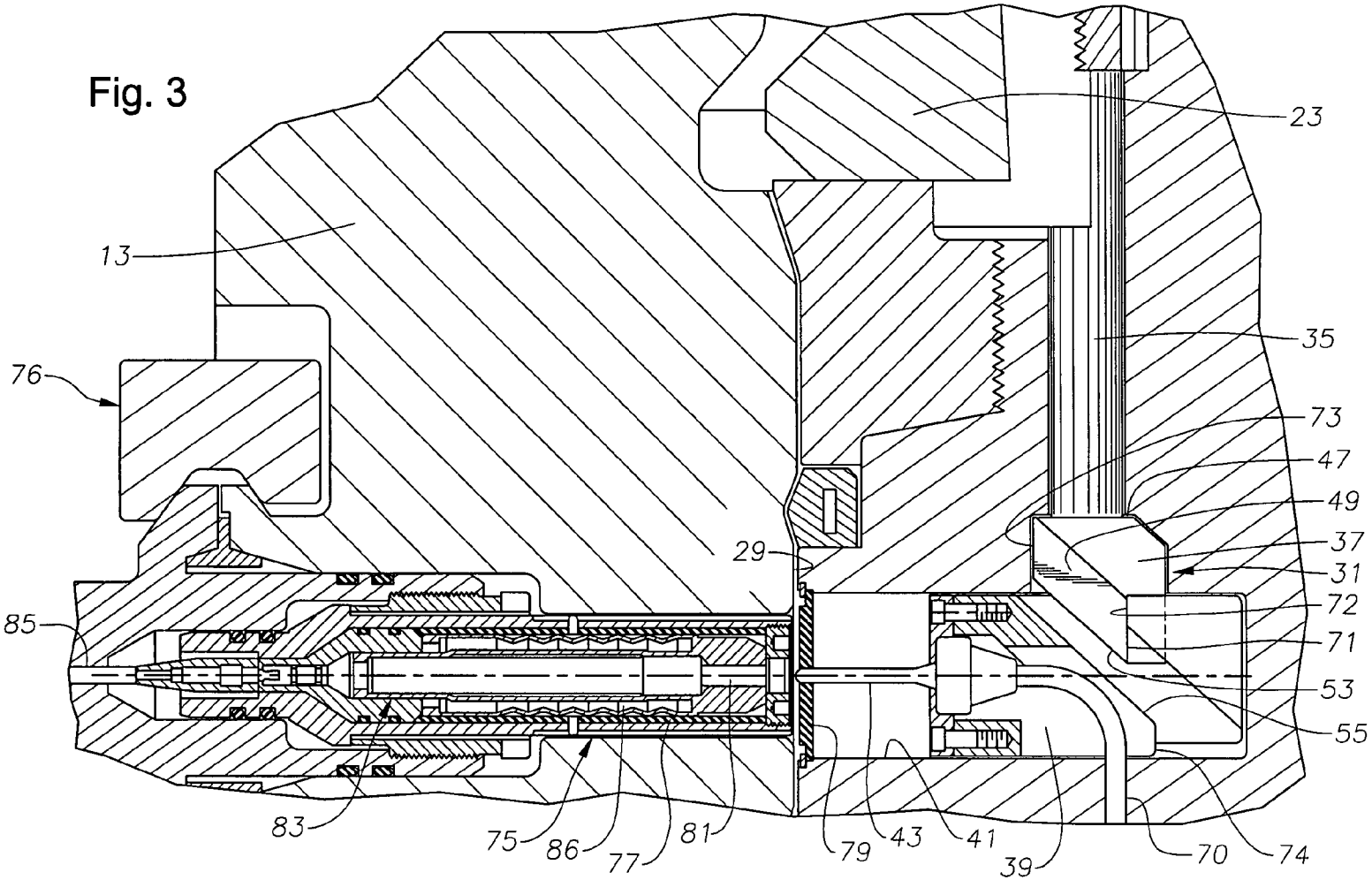
FIG. 3 is an enlarged cross-sectional side view of the connector of FIG. 1, the connector being in the disengaged position and positioned adjacent a female connector installed in the tree.

Like FIG. 1, FIG. 3 also shows connector 31 in the disengaged position. Sleeve 17 (FIG. 1) is initially spaced a selected distance from the upper end of rod 35, sleeve 17 moving downward for the selected distance before contacting rod 35, thereby limiting the movement of rod 35 to only a portion of the total movement of sleeve 17. In the disengaged position, lock surface 71 of block 37 engages lock surface 72 of block 39, preventing block 39 from moving outward. As rod 35 moves downward, lock surface 71 moves below lock surface 72, and block 37 causes block 39 to move outward (to the left in the figure) until surface 55 of block 39 moves from under surface 53 of block 37. At this point, block 37 continues moving downward as block 39 remains stationary, with lock surface 73 of block 37 sliding adjacent lock surface 74 of block 39. This positioning locks block 39 in the outward position. To complete installation of hanger 11, piston 16 of running tool 15 is lifted, and locking sleeve 17 remains in the downward position as running tool 15 is withdrawn. Sleeve 17 retains rod 35 and block 37 in their downward positions, locking block 39 in its outward position to move pin 43 into engagement with a female connector 75 in tree 13.

Referring to FIG. 3, a female wet-mate connector 75 is mounted in the sidewall of tree 13 for receiving pin 43 of connector 31, and hanger 11 is landed in tree 13 with connector 31 vertically and rotationally aligned with connector 75. Lock 76, shown in FIGS. 6 through 8 and described below, retains connector 75 within tree 13. Connector 75 may be of various types. In this embodiment, connector 75 is mounted with inner seal 77 approximately flush with bore 29, with inner seal 77 adjacent an outer seal 79 in cavity 41. Pin 43 passes through outer seal 79 as block 39 moves outward, and then pin 43 passes through inner seal 77 into receptacle 81 of conductor assembly 83. Receptacle 81 and conductor assembly 83 are formed from an electrically conductive material for conducting electricity from electrical cable 85 through conductor assembly 83 to pin 43. The electricity passes through pin 43 to cable 70 to power downhole components (not shown). Though shown with connectors 31, 75 in FIGS. 1 through 3, the connectors may be of various wet-mate types, for example, the connectors of the alternative embodiment of the invention shown in FIGS. 4 and 5. A flexible bladder 86 surrounds receptacle 83 and is filled with a dielectric gel. The exterior of bladder 86 is exposed to hydrostatic pressure within bore 29 of tree 13 that exists prior to running tubing hanger 11.

Referring to FIGS. 1 through 3, during installation of tubing hanger 11, female wet-mate connector 75 is connected to electrical cable 85 and installed with lock 76 in horizontal tree 13. Tree 13 is then installed at a subsea wellhead. Connector 31 is installed in cavity 41 of hanger 11 and connected to electrical cable 70, and rod 35 is installed in hanger 11 with the lower end of rod 35 inserted in male block 37. Outer seal 79 engages the outer end of pin 43 to prevent water or other contaminants from entering cavity 41. A locking sleeve 17 on hanger 11 is held in an upper position, dogs 23 and block 39 of connector 31 being in inner, disengaged positions. Hanger 11 is lowered with a running tool 15 into bore 29 of tree 13 and landed on a shoulder (not shown) in bore 29. Piston 16 of running tool 15 moves locking sleeve 17 downward, and cam surface 21 of skirt 19 forces dogs 23 outward to engage profile 27 of tree 13. After sleeve 17 travels downward a selected distance, skirt 19 contacts upper end 33 of rod 35, rod 35 then moving downward with sleeve 17. Rod 35 pushes block 37 downward and into contact with female block 39, rails 49 of block 37 sliding in grooves 51 of block 39. Surface 53 of block 37 applies force to and slides against surface 55 of block 39, block 39 moving outward as block 37 moves downward. Block 39 moves outward until surface 73 slides adjacent surface 74 to lock block 39 in the outer position. Pin 43 moves through outer seal 79 at the outer end of cavity 41 and enters connector 75 through inner seal 77. Pin 43 extends into receptacle 81, forming an electrical connection between cable 85 and cable 70 through connectors 75, 31. Installation of hanger 11 is completed by lifting piston 16 of running tool and retrieving running tool.

To remove hanger 11, running tool 15 is lowered to the subsea installation and into engagement with tree 13 and hanger 11. Piston 16 lifts locking sleeve 17, allowing dogs 23 to move inward out of engagement with tree 13. As sleeve 17 moves upward, rod 35 and block 37 also move upward. Upper surfaces 57 of rails 49 slide against surfaces 59 of grooves 51 for causing block 39 to move inward, pin 43 moving out of engagement with connector 75. Hanger 11 can then be retrieved from within bore 29.

Figure 4:
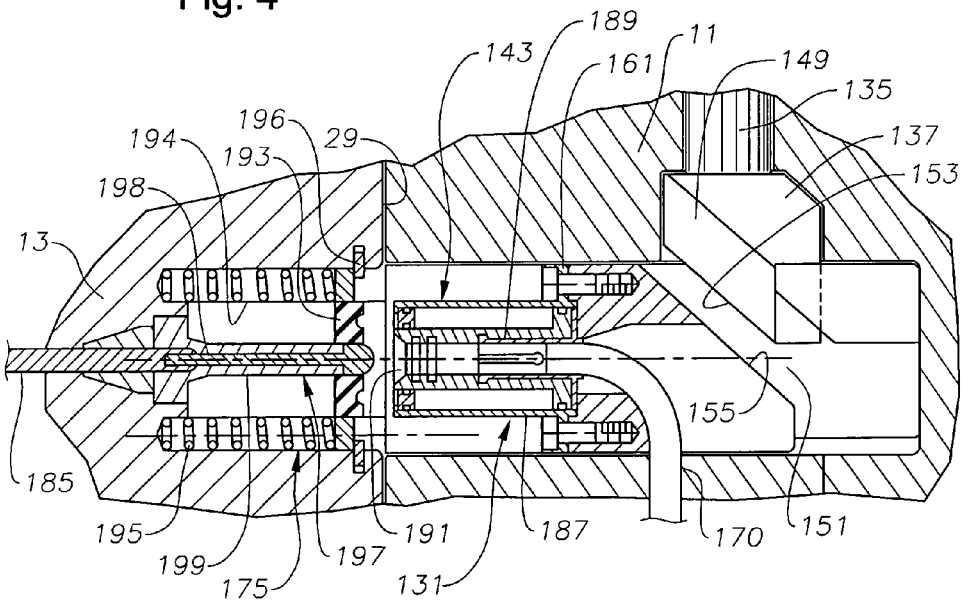
FIG. 4 is a cross-sectional side view of an alternate embodiment of the connector of the invention, the view showing the connector in a disengaged position.
Figure 5:
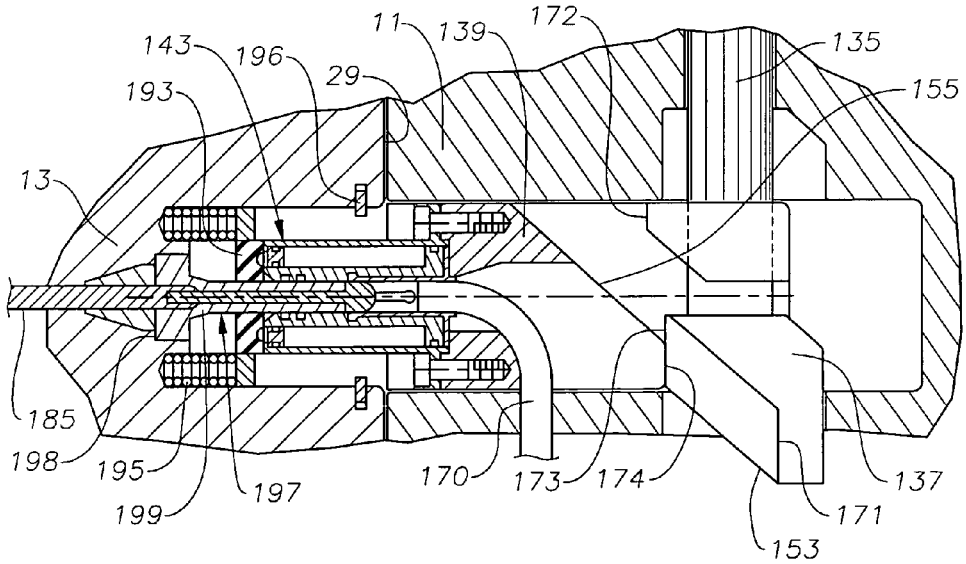
FIG. 5 is a cross-sectional side view of the embodiment of FIG. 4, the connector being shown in an engaged and locked position.

An alternate embodiment of the invention is shown in FIGS. 4 and 5, with similar numbers corresponding to the numbers of similar components in the embodiment of FIGS. 1 through 3. Tubing hanger 11 is shown landed within horizontal tree 13. Prior to installation of hanger 11, male connector 131 is installed within hanger 11, connector 131 comprising rod 135, male block 137 and female block 139. Blocks 137, 139 interact in the manner as blocks 37, 39 in the embodiment described above. Rod 135 is forced downward by sleeve 17 (FIG. 1), pushing block 137 downward and into engagement with block 139. Rails 149 of block 137 enter and slide within grooves 151 of block 139, and surface 153 contacts and slides against surface 155. As block 137 moves downward, rails 149 and surface 153 causes block 139 to move outward toward a female connector 175 installed in tree 13. FIG. 4 shows block 139 in the disengaged position, and FIG. 5 shows block 139 in the engaged and locked position. In the disengaged position, lock surface 171 of block 137 engages lock surface 172 of block 139 for preventing block 139 from moving outward. In the engaged position, lock surface 173 of block 137 contacts lock surface 174 of block 139 for preventing block 139 from moving inward.

Pin mount 161, from which tubular pin 143 extends outward, comprises the outer end of block 139. Pin 143 has a tubular body 187 that encloses a receptacle 189, receptacle 189 having a chamfered outer opening 191 for guiding a corresponding pin within connector 175 into receptacle 189. Receptacle 189 is connected to electrical cable 170 for conducting electricity from connector 175 through receptacle 189 and down cable 170 to downhole components.

Connector 175 is installed in tree 13 prior to installation of tree 13 at a subsea location. As hanger 11 is landed within tree 13, connectors 131, 175 are vertically and rotationally aligned, allowing for pin 143 to engage connector 175 as block 139 moves outward. An elastomeric, ring-shaped piston 193 is movably carried within a bore 194 in connector 175, pin 143 of connector 131 contacting piston 193 for moving piston 193 outward with pin 143. The diameter of bore 194 is sized to receive the outer diameter of body 187 of pin 143. Piston 193 is biased toward bore 29 of tree 13 by springs 195, and retaining ring 196 provides an inward stop for piston 193. A pin 197 extends inward from the outer end of bore 194 and through the central portion of piston 193, piston 193 sealingly engaging the surface of pin 197. Pin 197 comprises a conductive portion 198 and a non-conductive portion 199, portion 198 forming the inner end of pin 197. Pin 197 is sized for insertion into receptacle 189 of pin 143 and is connected to electrical cable 185 at the outer end for conducting electricity from a source to pin 197.

During installation of hanger 11, connector 175 is installed in tree 13, which is then installed at a subsea well. Connector 131 is installed in hanger 11, and then hanger 11 is landed within tree 13 using a running tool 15 (FIG. 1). Running tool 15 forces a locking sleeve 17 (FIG. 1) downward, which causes rod 135 to move downward. Rod 135 forces block 137 downward, with rails 149 engaging grooves 151 and surfaces 153, 155 sliding against each other, causing block 139 to move outward. As pin 143 of connector 131 moves outward toward the engaged position, which is shown in FIG. 5, pin 143 first contacts piston 193 and begins forcing piston 193 outward. This movement moves piston 193 outward through bore 194 and compresses springs 195. Pin 143 enters bore 194 of connector 175 as pin 197 of connector 175 enters receptacle 189. Prior to engagement, piston 193 seals against the inner end of conductive portion 198 of pin 197. As piston 193 moves inward, conductive portion 199 contacts the inside surface of receptacle 189, providing a conductive path from cable 185, through pin 197, into receptacle 189, and out through cable 170.

Figure 7:
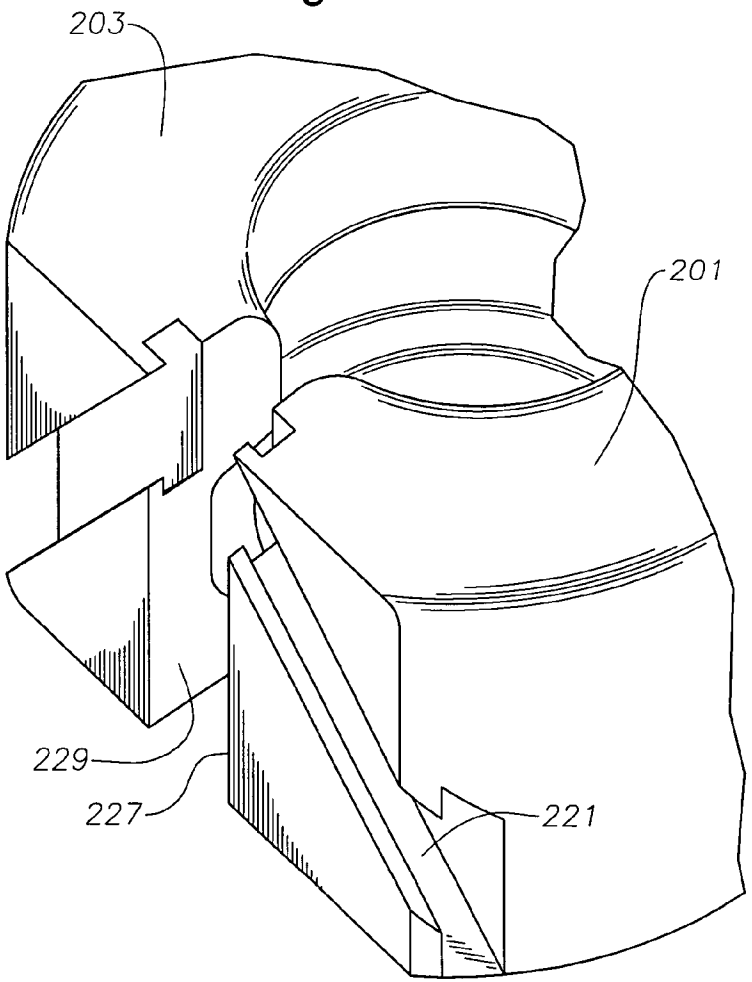
FIG. 7 is an enlarged view of a section of the lock of FIG. 6, a portion of the lock being removed.
Figure 6:
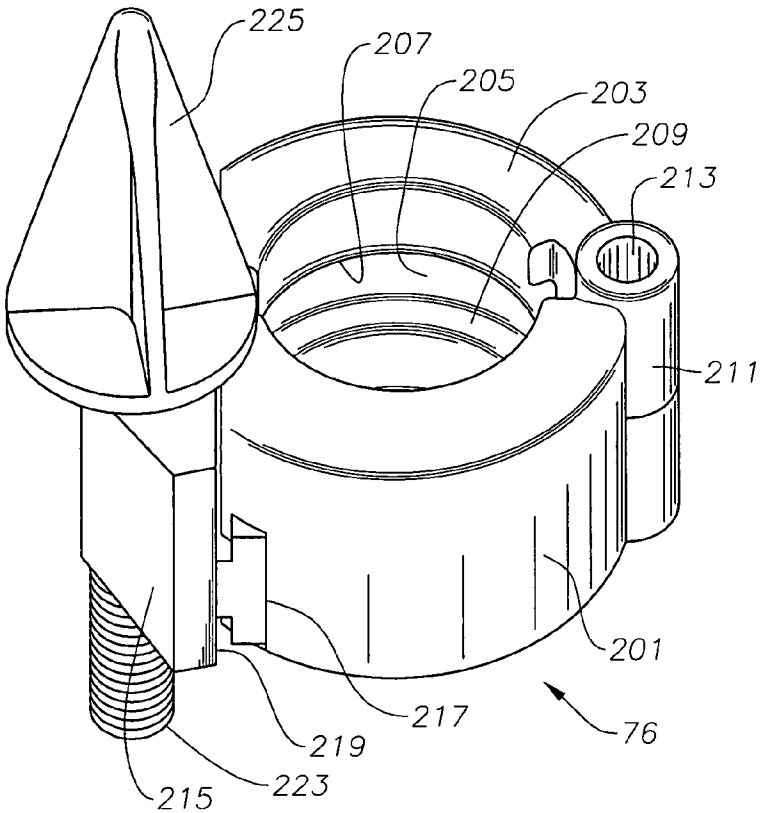
FIG. 6 is a perspective view of a lock used to retain the tree connector of FIG. 1.

To allow for subsea installation and removal of connector 75 (FIG. 3) using a remotely operated vehicle (ROV), lock 76 is used to retain connector 75 within the sidewall of tree 13. FIG. 6 shows lock 76 assembled and read for installation. Lock 76 comprises two opposing clamp sections 201, 203, each having an internal recess 205 for forming outer lips 207 and inner lips 209. Clamp sections 201, 203 are pivotally connected to each other at hinge 211, and a bolt (not shown) is inserted through hole 213 in hinge 211 for mounting lock 76 on an exterior surface of tree 13. A wedge member 215 moveably engages ends of clamp sections 201, 203 opposite hinge 211 with ramps 217 formed on surface 219 of wedge member 215. Ramps 217 lie at an angle relative to a plane bisecting hinge 211 and wedge member 215 and engage corresponding slots 221 (FIG. 7) on clamp sections 201, 203. A threaded shaft 223 threadingly engages wedge member 215, shaft 223 being rotated by an ROV at a hub 225 on an outer end of shaft 223. FIG. 7 is a view of the ends of clamp sections 201, 203, wedge member 215 having been removed to show slots 221. Slots 221 are formed to have the same angle as ramps 217 (FIG. 6) and are sized to receive ramps 217.

Referring to FIGS. 6 and 7, in operation, as shaft 223 is rotated to move wedge member 215 outward (toward hub 225) along shaft 223, ramps 217 slide within slots 221, pivoting clamp sections 201, 203 about hinge 211 and spreading apart the ends of sections 201, 203 to open lock 76. This creates a larger gap between faces 227, 229 of sections 201, 203, respectively. As shaft 223 is rotated to move wedge member 215 inward, ramps 217 cause clamp sections 201, 203 to pivot toward each other, closing lock 76 and reducing the gap between faces 227, 229.

Figure 8:
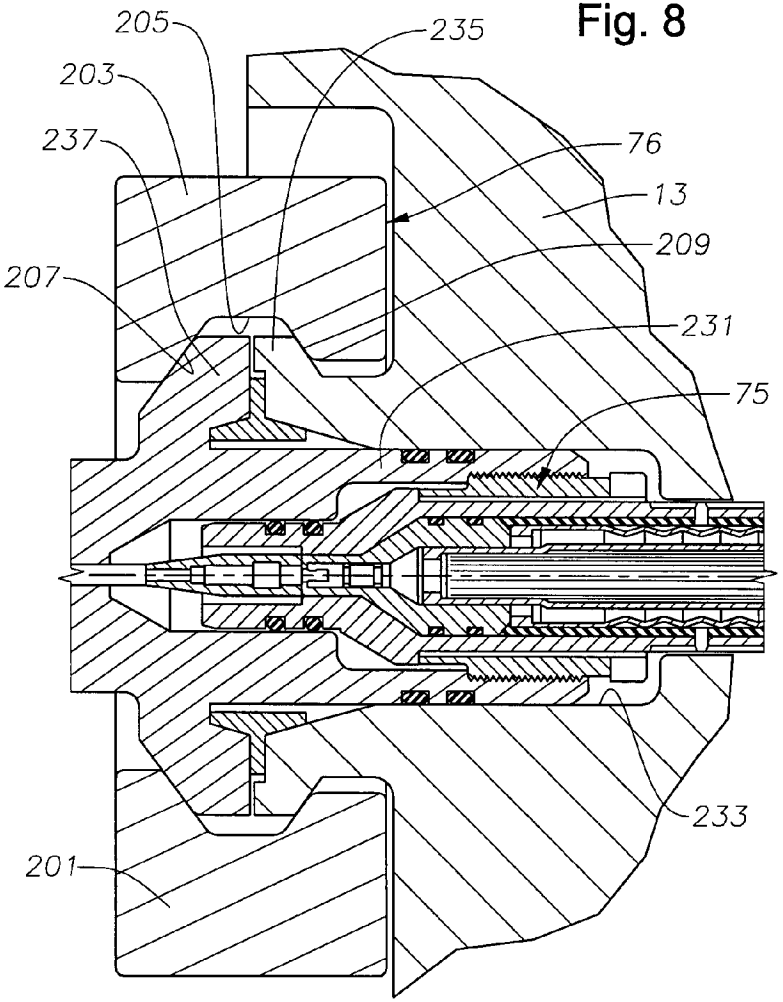
FIG. 8 is an enlarged cross-sectional view of the tree connector of FIG. 1, the lock of FIG. 6 retaining the lock in the tree.

FIG. 8 shows connector 75 installed in tree 13. Connector 75 is installed in connector housing 231, the inner end of which is then inserted into bore 233. A flange 235 is formed around bore 233, and a flange 237 is formed on connector housing 231, flanges 235, 237 having approximately the same outer diameter. During installation, lock 76 is opened, as described above, and clamp sections 201, 203 are positioned around flanges 235, 237. Lock 76 is then closed, with flanges 235, 237 being located in recess 205 and lips 207, 209 securing flanges 235, 237 together. Connector housing 231 is thus retained within bore 233 of tree 13, and connector 75 is located for engagement by connector 31 (FIG. 1).

Several advantages are realized from the present invention. A wet-mate connector and the actuating mechanism for engaging the connector are carried in the tubing hanger, which is easily retrieved for maintenance or repair. The connector is actuated when the piston of the running tool moves the locking sleeve of the tubing hanger into place, obviating the need for additional actuating components required for a connector carried in the tree. Additionally, the connector in the hanger is locked in position when the actuating mechanism passes through its full travel. A lock operable by an ROV retains the connector in the tree, allowing for removal and installation of the connector without having to retrieve the tree from a subsea location.

While the invention has been described in only one of its forms, it should be apparent to those skilled in the art that it is not so limited, but is susceptible to various changes without departing from the scope of the invention. For example, the conductor pin in the tubing hanger could alternately be stroked inward and outward by a hydraulic piston. The piston could be supplied with hydraulic pressure by the running tool for the tubing hanger.

I claim:

1. A wellhead assembly, comprising:

an outer wellhead member adapted to be mounted to an upper end of a well and having a sidewall defining a bore;

a tubing hanger assembly having a tubing hanger body adapted to be secured to a string of tubing that is lowered into and lands in the bore;

an electrical connection outer electrical member having an inner end mounted in a passage formed in the sidewall, the outer electrical member adapted to be connected to an exterior electrical conductor on the exterior of the outer wellhead member;

an electrical connection inner electrical member mounted to the tubing hanger body for axial movement therewith and adapted to be connected to an interior electrical conductor leading to equipment in the well, the inner electrical member having an outer end that is movable from a retracted position to an extended position within the passage in electrical engagement with the inner end of the outer electrical member; and an actuator carried by the tubing hanger assembly in cooperative engagement with the inner electrical member for moving the inner electrical member to the extended position after the tubing hanger body and the inner electrical member have landed in the bore.

2. The wellhead assembly according to claim 1, further comprising:

a running tool for moving the lock member to the set position;

wherein the tubing hanger assembly further comprises a lock member on the tubing hanger body that is moved by the running tool from a retracted position to a set position in engagement with a profile within the outer wellhead member; and wherein the actuator moves the inner electrical member to the extended position in response to the running tool moving the lock member to the set position.

3. The wellhead assembly according to claim 1, wherein the actuator comprises:

a lateral actuator member secured to an inner end of the inner member, the lateral actuator member being laterally movable relative to an axis of the tubing hanger body for moving the inner electrical member from the retracted position, the lateral actuator member having an inclined profile; and an axial actuator member having a lower end with an inclined profile that slidingly engages the profile of the lateral actuator member, the axial actuator member extending axially upward from the lateral actuator member, so that upward movement of the axial actuator member causes the lateral actuator member to move laterally inward and downward movement of the axial actuator causes the lateral actuator member to move laterally outward.

4. The wellhead assembly according to claim 1, wherein the outer end of the inner electrical member moves in straight radial movement from the retracted to the extended position.

5. A wellhead assembly, comprising:

an outer wellhead member adapted to be mounted to an upper end of a well and having a sidewall defining a bore;

a tubing hanger that lands in the bore and is adapted to be connected to a string of tubing extending into the well;

a running tool that releasably engages the tubing hanger and has an setting member that moves axially for setting the tubing hanger in the bore;

an electrical connection outer member mounted in a passage formed in the sidewall, the outer member having an outer end adapted to be connected to an exterior electrical conductor on the exterior of the outer wellhead member and an inner end;

an electrical connection inner member mounted to the tubing hanger and adapted to be connected to an interior electrical conductor leading to equipment in the well, the inner member being movable in response to axial movement of the setting member of the running tool from a retracted position to an extended position in electrical engagement with the inner end of the outer member;

a lateral actuator member secured to an inner end of the inner member, the lateral member being laterally movable relative to an axis of the inner wellhead member for moving the inner member from the retracted position, the lateral actuator member having an inclined profile; and an axial actuator member having a lower end with an inclined profile that slidingly engages the profile in the lateral actuator member, the axial actuator member extending axially upward from the lateral actuator member in engagement with the setting member of the running tool, so that upward movement of the setting member causes the axial actuator member to move up and the lateral actuator member to move laterally inward, and downward movement of the setting member causes the axial actuator to move downward and the lateral actuator member to move laterally outward.

6. A method of electrically connecting a downhole electrical component in a well to the surface, the well having an outer wellhead member at an upper end of the well, the method comprising:

(a) mounting an outer electrical member of an electrical connection in a passage formed in a sidewall of the outer wellhead member, the outer electrical member having an inner end located in the passage;

(b) mounting an inner wellhead member on a string of conduit;

(c) mounting an inner electrical member of an electrical connection to the inner wellhead member in a retracted position; then (d) lowering the inner wellhead member, the string of conduit and the inner electrical member into the well and landing the inner wellhead member in the outer wellhead member; and then (e) after ceasing downward movement of the inner wellhead member, the string of conduit and the inner electrical member, extending the inner electrical member outward into the passage in electrical engagement with the outer electrical member.

7. The method according to claim 6, wherein:

step (b) comprises securing the inner wellhead member to a running tool;

step (c) comprises mounting an actuator to the inner electrical member of the electrical connection;

step (d) further comprises after landing the inner wellhead member in the outer wellhead member, operating the running tool to set a locking member between the inner wellhead member and the outer wellhead member; and wherein step (e) comprises simultaneously with setting the locking member, performing step (e) by engaging the running tool with the actuator and moving the actuator downward with the running tool to extend the inner electrical member outward.

8. The method according to claim 6 wherein step (e) comprises moving the inner electrical member along a straight radial line.

9. A method of electrically connecting a downhole electrical component in a well to the surface, the well having an outer wellhead member at an upper end of the well, the method comprising:

(a) mounting an outer member of an electrical connection in a passage formed in a sidewall of the outer wellhead member, the outer member having an inner end located in the passage;

(b) mounting an inner wellhead member on a string of conduit;

(c) mounting an inner member of an electrical connection to the inner wellhead member in a retracted position; then (d) landing the inner wellhead member in the outer wellhead member; and then (e) extending the inner member outward into the passage in electrical engagement with the outer member; wherein:

step (b) comprises securing the inner wellhead member to a running tool that has an axially movable setting member;

step (d) comprises moving the setting member downward to secure a locking member between the inner wellhead member and the outer wellhead member; and wherein step (e) comprises extending the inner member outward in response to the said downward movement of the setting member.

* * * * *